United States Patent [19]

Sanada et al.

[11] 4,207,277

[45] Jun. 10, 1980

[54] FLOAT CHAMBER MEANS FOR A CARBURETOR

[75] Inventors: Masakatsu Sanada; Toshimitsu Ito, both of Toyota, Japan

[73] Assignee: Toyota Jidosha Kogyo Kabushiki Kaisha, Japan

[21] Appl. No.: 862,840

[22] Filed: Dec. 21, 1977

[30] Foreign Application Priority Data

Oct. 19, 1977 [JP] Japan ..... 52-125301

[51] Int. Cl.[2] ..... F02M 15/04

[52] U.S. Cl. ..... 261/130; 123/122 E; 123/122 F; 123/122 H; 261/142; 261/145; 261/DIG. 74

[58] Field of Search ..... 261/142, 145, 130; 123/122 E, 122 F, 122 H

[56] References Cited

U.S. PATENT DOCUMENTS

| | | | |
|---|---|---|---|
| 1,130,915 | 3/1915 | Mansbridge et al. | 123/122 F |
| 1,150,619 | 8/1915 | Percival et al. | 261/142 |
| 1,237,862 | 8/1917 | Bintliff | 261/142 |
| 1,318,068 | 10/1919 | Giesler | 123/122 E |
| 1,398,012 | 11/1921 | Foster | 261/142 |
| 1,514,937 | 11/1924 | Shaw | 261/144 |
| 1,744,082 | 1/1930 | Ross | 261/142 |
| 1,884,963 | 10/1932 | Aseltine | 261/142 |
| 1,968,870 | 8/1934 | Beals | 261/142 |
| 1,973,362 | 9/1934 | Weiertz et al. | 261/142 |
| 2,087,792 | 7/1937 | Beals | 261/142 |
| 2,096,407 | 10/1937 | Reitmeyer | 261/130 |
| 2,112,973 | 4/1938 | Nicosia | 123/122 F |
| 2,134,877 | 11/1938 | Jedrzykowski | 261/41 D |
| 2,766,974 | 10/1956 | McConnell | 261/145 |
| 3,215,413 | 11/1965 | Szwargulski et al. | 261/41 D |
| 3,913,543 | 10/1975 | Richard | 123/122 E |
| 4,027,639 | 6/1977 | Amano | 123/122 E |

FOREIGN PATENT DOCUMENTS

| | | | |
|---|---|---|---|
| 179319 | 9/1917 | Canada | 261/142 |
| 476333 | 7/1915 | France | 261/142 |
| 729721 | 7/1932 | France | 261/142 |
| 231327 | 3/1944 | Switzerland | 261/142 |
| 927378 | 5/1963 | United Kingdom | 261/39 B |

OTHER PUBLICATIONS

1972 Chevrolet Shop Manual, p. 6K-4, General Motors Corp.

*Primary Examiner*—Tim R. Miles

*Attorney, Agent, or Firm*—Stevens, Davis, Miller & Mosher

[57] ABSTRACT

A float chamber means for a carburetor having a heating element provided in its float chamber for selectively heating liquid fuel contained in the float chamber so that highly volatile components included in the fuel are vaporized in the float chamber and released from the liquid fuel before it enters into fuel passages provided in the carburetor thereby avoiding percolation due to abnormal vaporization of fuel in those fuel passages.

8 Claims, 8 Drawing Figures

FLOAT CHAMBER MEANS FOR A CARBURETOR

BACKGROUND OF THE INVENTION

The present invention relates to a carburetor for an internal combustion engine and, more particularly, to a float chamber means for the carburetor.

A carburetor incorporated in the internal combustion engine of an automobile is cooled during operation of the engine by the draught generated by the radiator cooling fan and also by the flow of intake air, and heat absorbing vaporization of liquid fuel. Furthermore, when the automobile is running, the cooling effect applied to the carburetor is increased by the draught caused by the running of the automobile. Due to these cooling functions the carburetor is generally maintained at a moderate temperature which does not cause abnormal vaporization of fuel flowing through the passages formed therein. However, when the engine has been abruptly put into idling operation or stopped after high speed, high load operation, the temperature of the engine and of the air existing in the engine compartment temporarily rises so high that it often causes percolation due to abnormal vaporization of liquid fuel in the passages provided in the carburetor. Such a percolation is principally caused by highly volatile components included in liquid fuel such as gasoline. The conventional method for avoiding percolation is generally to improve the cooling effect applied to the carburetor by employing various cooling means. However, the conventional cooling method is still not sufficient to suppress completely the occurrence of percolation in carburetors.

SUMMARY OF THE INVENTION

It is the object of the present invention to provide a novel means for effectively suppressing the occurrence of percolation in carburetors, which is quite different from the conventional cooling method.

In accordance with the present invention, the abovementioned object is accomplished by providing a float chamber means of a carburetor comprising a float chamber, a fuel inlet port which opens to said float chamber for supplying fuel thereinto, a fuel outlet port which opens to said float chamber at a lower portion thereof for delivering fuel therefrom, a vent port which opens to said float chamber at an upper portion thereof for discharging gases therefrom, and a heating element provided in said float chamber for selectively heating liquid fuel contained in said float chamber.

By employing a float chamber means of the abovementioned structure, highly volatile components included in liquid fuel, which principally cause percolation, are vaporized within the float chamber so as to be fractionally separated from the liquid fuel which is delivered from the fuel outlet port through passages formed in the carburetor toward the main fuel nozzle, slow port, idle port, etc.. Therefore, the liquid fuel contained in the fuel passages provided in the carburetor is less volatile and is more stable against abnormal vaporization which will cause percolation.

However, it is desirable that the heating of liquid fuel in the float chamber is effected only when the engine or carburetor is heated up to a high temperature which is likely to cause percolation. Therefore it is desirable that the operation of the heating element is dependant upon the temperature condition of the engine or carburetor.

The highly volatile components vaporized in the float chamber due to positive heating of liquid fuel are discharged from the vent port and are introduced into the intake bore of the carburetor through an inner air vent or into a fuel vapor absorbing means such as a charcoal canister through an outer air vent.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENT

Figure 1:
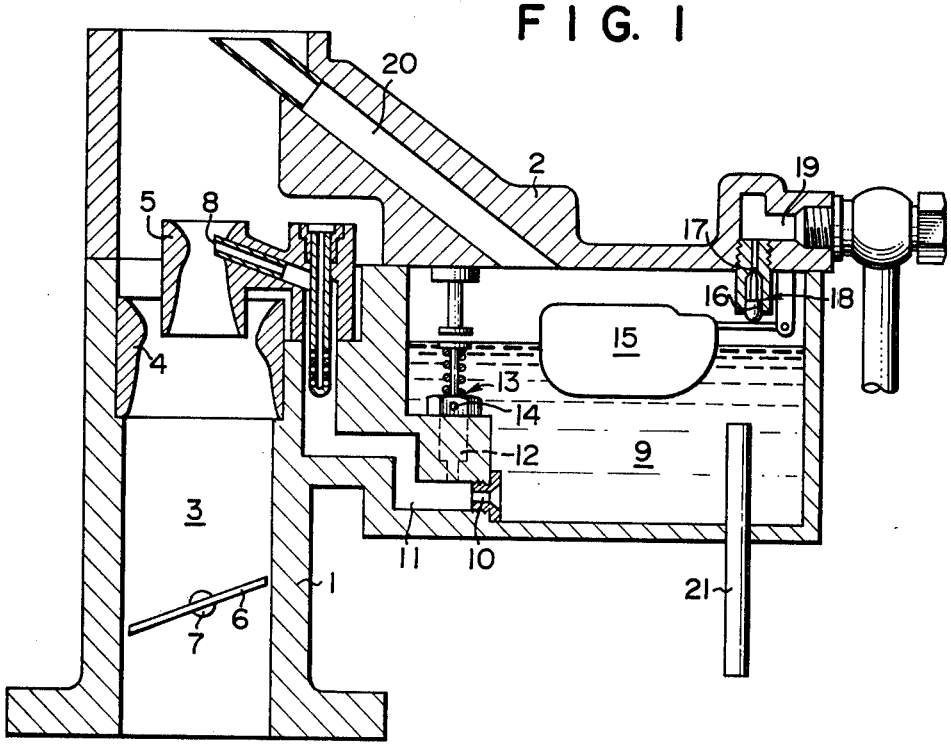
FIG. 1 is a rather diagrammatical longitudinal sectional view of a carburetor which incorporates an embodiment of the float chamber means of the present invention.

Referring to FIG. 1, the carburetor herein shown has a conventional assembly of a body 1 and an air horn 2, the latter being mounted onto the former so as to provide a carburetor housing having an intake bore 3. At a middle portion of the intake bore 3 is provided a large venturi 4, and adjacent to the throat portion of the large venturi is provided a small venturi 5. Furthermore, at a downstream portion of the large venturi 4 in the intake bore 3 is provided a throttle valve 6 supported by a throttle shaft 7 so as to be rotatable around its axis. A main nozzle 8 opens at the throat portion of the small venturi 5 and is adapted to be supplied with fuel from a float chamber 9 defined by the body 1 and the air horn 2 through a main jet 10 for metering the supply of fuel and a main fuel passage 11.

Furthermore, a power fuel passage 12 is connected to a middle portion of the main fuel passage 11 so as to permit an additional flow of fuel therethrough from the float chamber 9 to the main fuel passage 11 under the control of a power valve 13 which has a power fuel inlet port 14 and opens when the throttle valve is opened beyond a predetermined opening.

A float 15 is provided in the float chamber 9 and controls a needle element 16 cooperating with a needle seat 17 in a needle valve means 18 so as to control the supply of liquid fuel into the float chamber made through a fuel inlet port 19 and to maintain a constant level of liquid fuel in the float chamber. The liquid fuel such as gasoline contained in the float chamber is delivered therefrom through the main jet 10, and also through the power fuel port 14 in power condition, and through the main fuel passage 11. On the other hand, fuel gases generated in the float chamber are discharged through an inner air vent 20 to be introduced into the intake bore 3.

A heat pipe 21 is provided so as to penetrate a wall portion of the body 1 which defines a bottom portion of the float chamber 9. The upper portion of the heat pipe is located within the float chamber, whereas the lower portion thereof is exposed to the atmosphere outside the carburetor. Because of the provision of such a heat pipe, when the temperature of the air in the engine compartment is higher than that of the fuel contained in the float chamber, the heat pipe receives heat from the air in the engine compartment at its lower portion, transmits the heat to its upper portion through itself, and gives the heat to the fuel contained in the float chamber, whereby the fuel contained in the float chamber is positively heated by the heat pipe. Therefore, when the air in the engine compartment becomes very hot, as in the idling operation performed just after high speed, high load operation wherein the possibility of causing percolation is very high, an increased amount of heat is transferred from the hot air in the engine compartment to the fuel contained in the float chamber by the heat pipe, whereby an increased rate of highly volatile components is released from liquid fuel before it enters into the fuel passages provided in the carburetor. Therefore, the heating effected for liquid fuel contained in the float chamber is automatically adjusted in accordance with the requirement for heating liquid fuel in view of suppressing percolation.

Figure 2:
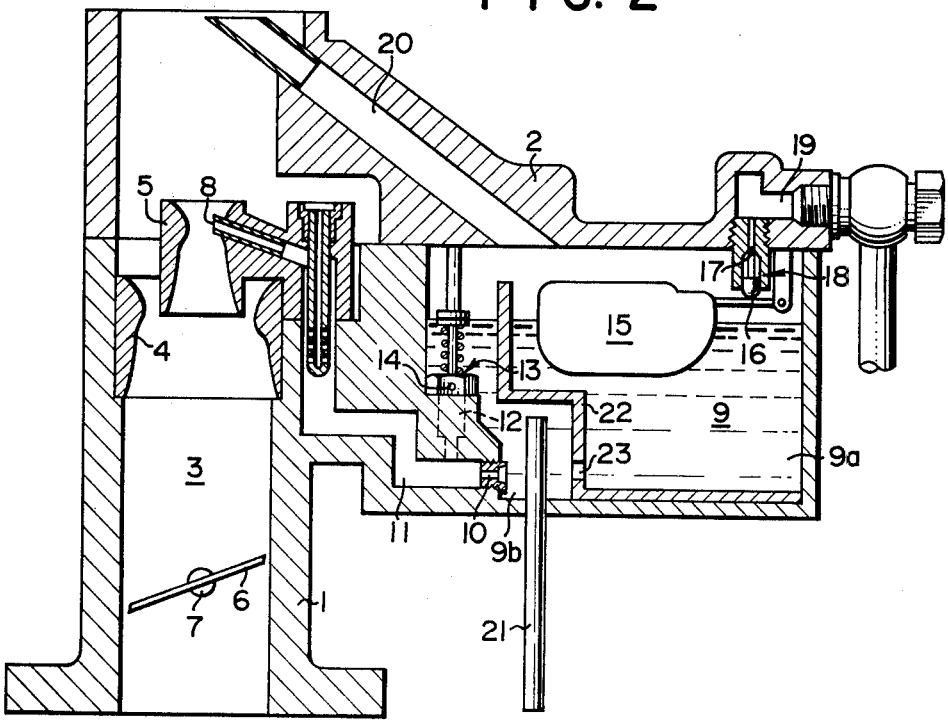
FIG. 2 is a view similar to FIG. 1 showing a modification of the embodiment shown in FIG. 1.

FIG. 2 is a view similar to FIG. 1 showing another embodiment of the present invention. In FIG. 2 the portions corresponding to those shown in FIG. 1 are designated by the same reference numerals. In the embodiment shown in FIG. 2, the internal space of the float chamber 9 is divided into a first region 9*a* to which the fuel inlet port including the needle valve means 18 opens, and a second region 9*b* to which fuel outlet ports such as the main nozzle 10 and the power fuel port 14 open, by a partition 22. The first and second regions 9*a* and 9*b* are in communication with each other through a small opening 23 provided in the partition 22. The heat pipe 21 is located in the second region 9*b* so as to heat principally the liquid fuel existing in the second region. In this structure, highly volatile components are more effectively removed from the liquid fuel which is drawn through the main fuel passage 11, whereby the percolation due to abnormal vaporization of liquid fuel in the fuel passages such as the main passage 11 is more effectively avoided. When the engine has been stopped for a long time, the content of highly volatile components is uniformalized in the entire region of the float chamber 9 due to mixture of fuel through the opening 23 so that the content of highly volatile components in the region 9*b* is substantially recovered. Therefore, the startability of the engine when cold will not be affected by the provision of the partition 22.

Figure 3:
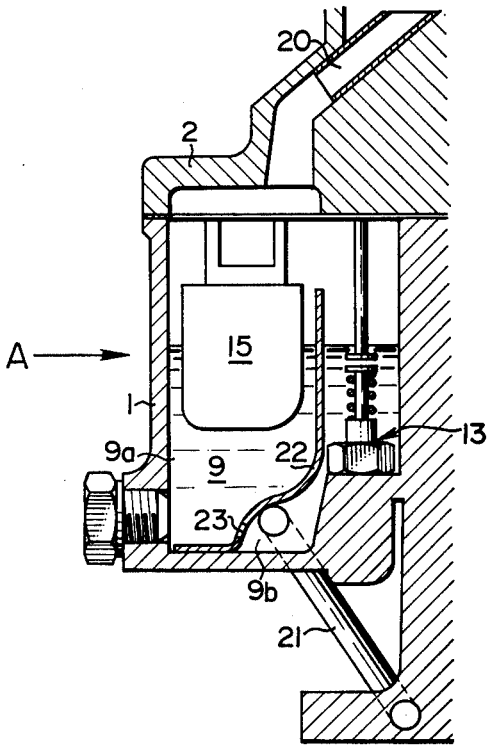
FIG. 3 is a fragmentary sectional view showing the essential parts of a carburetor which incorporates another embodiment of the float chamber means of the present invention.
Figure 4:
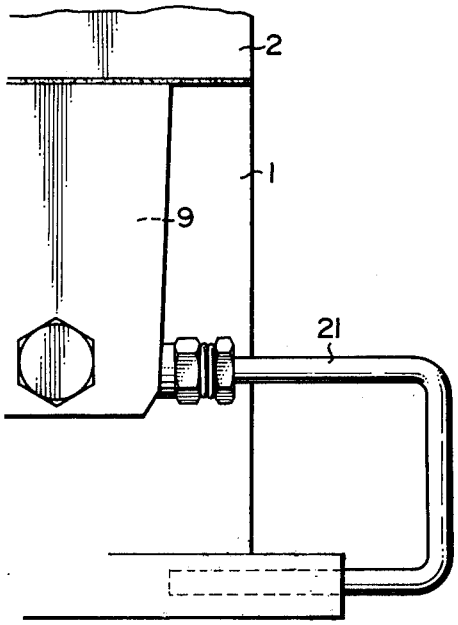
FIG. 4 is a view taken along arrow A in FIG. 3.

In FIGS. 3 and 4 is shown another embodiment of the present invention. Also in these figures, the portions corresponding to those shown in FIGS. 1 and 2 are designated by the same reference numerals. In this embodiment the lower end portion of the heat pipe 21 is mounted into the body of the carburetor so that the heat pipe receives heat from the body 1 and transfers it to the fuel existing in the second region 9*b* of the float chamber 9. By this arrangement, the positive heating of the fuel in the float chamber is made in accordance with the temperature of the body 1 of the carburetor. The position in the body 1 where the lower end portion of the heat pipe is mounted may be judiciously selected in accordance with the individual design of the carburetor.

Figure 5:
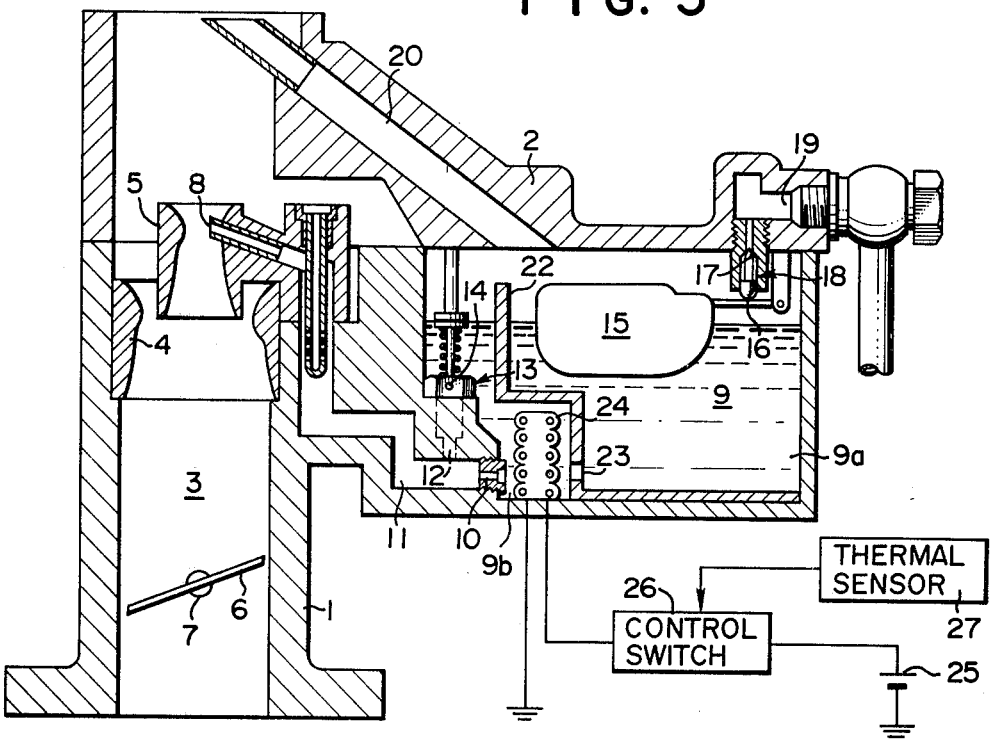
FIG. 5 is a view similar to FIGS. 1 and 2 showing still another embodiment of the present invention.

FIG. 5 shows still another embodiment of the present invention by a sectional view similar to FIGS. 1 and 2. Also in FIG. 5 the portions corresponding to those shown in FIGS. 1 and 2 are designated by the same reference numerals. In this embodiment an electric heating element 24 is provided for selectively heating liquid fuel existing in the second region 9*b* of the float chamber. The electric heating element 24 is selectively supplied with electric current from a battery 25 through a control switch 26 which operates in accordance with a signal received from a thermal sensor 27 for detecting the temperature of the engine. When the thermal sensor 27 is detecting a temperature above a pre-determined value, the control switch 26 is closed so as to energize the electric heating element 24, whereas if the thermal sensor 27 is detecting a temperature below this pre-determined value, the control switch 26 is opened so as to deenergize the electric heating element 24.

Figure 6:
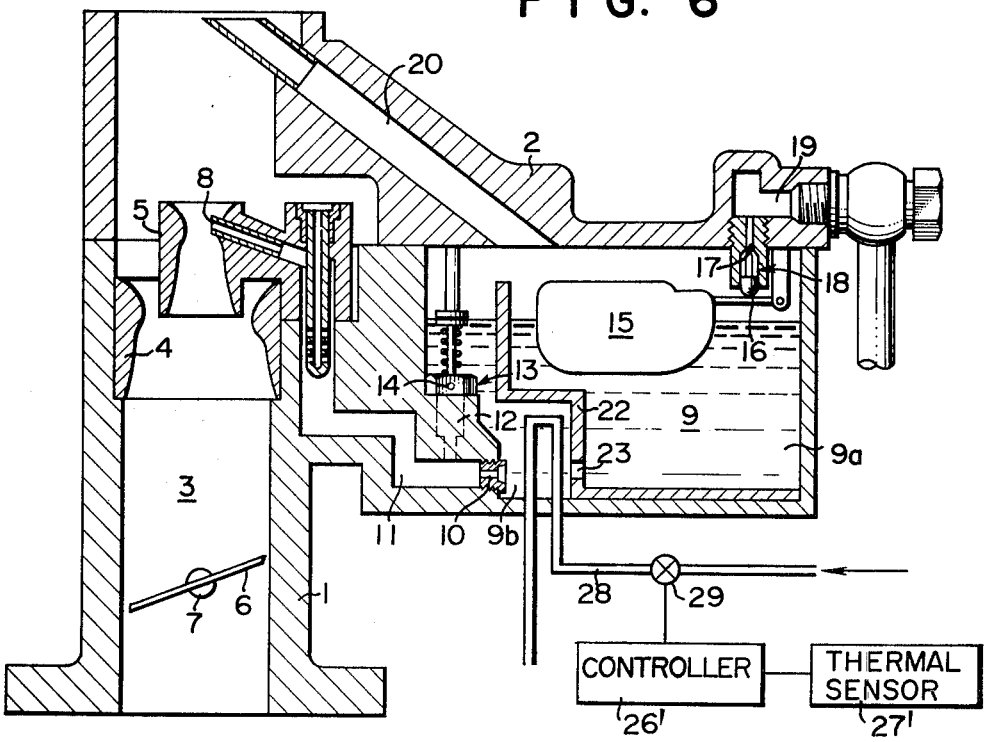
FIG. 6 is a view similar to FIGS. 1, 2 and 5 showing still another embodiment of the present invention.

FIG. 6 shows still another embodiment of the invention, similar to that shown in FIG. 5. In this embodiment a pipe 28 is provided for selectively heating the fuel existing in the second region 9*b* of the float chamber, said pipe being selectively supplied with heating medium such as engine cooling water or exhaust gases through a control valve 29 which is operated by a controller 26' which operates depending upon a signal received from a thermal sensor 27' for detecting the temperature of the engine. When the thermal sensor 27' is detecting a temperature above a pre-determined value, the valve 29 is opened so as to supply heating medium through the pipe 28, whereas when the thermal sensor 27' is detecting a temperature below this pre-determined value, the valve 29 is closed so as to shut down the heating pipe 28.

Figure 7:
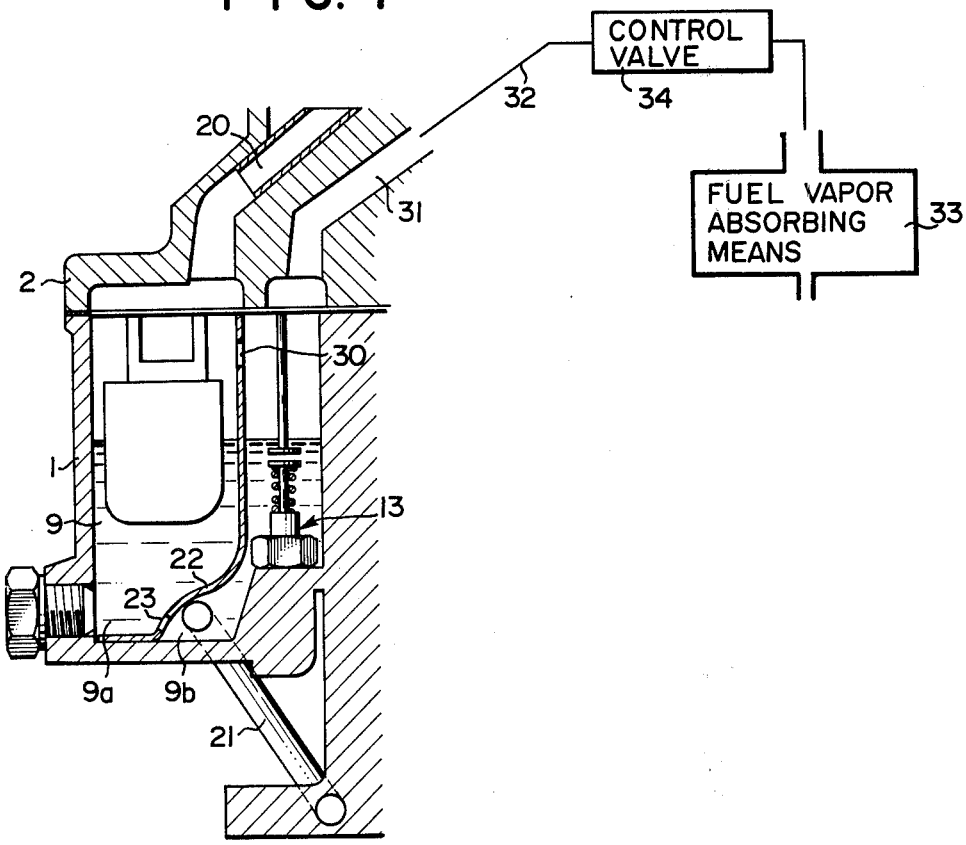
FIG. 7 is a view similar to FIG. 3 showing a further modification of the present invention.

FIG. 7 shows a modification of the embodiment in FIG. 3. Also in FIG. 7, the portions corresponding to those shown in FIG. 3 are designated by the same reference numerals. In this embodiment the partition 22 extends so as to divide completely the space of the float chamber into two regions 9*a* and 9*b*, although the partition has a further opening 30 located at its upper portion so as to provide a small communication between the gas phases in the regions 9*a* and 9*b*. The gas phase in the region 9*a* is connected with the inner air vent 20, while the gas phase in the region 9*b* is connected with an outer air vent 31 which is connected to a fuel vapor absorbing means 33 such as a charcoal canister by way of a conduit 32 including a control valve 34. The control valve 34 is adapted to open when the engine is idling or stopped and to close in other operating conditions. Idling operation or stoppage of the engine can be detected by the opening of the throttle valve or intake manifold vacuum. In this embodiment, therefore, the fuel vapor generated in the second region 9*b* during idling operation or stoppage of the engine is absorbed by the fuel vapor absorbing means 33 and is supplied to the engine for combustion when it is in other operating conditions.

Figure 8:
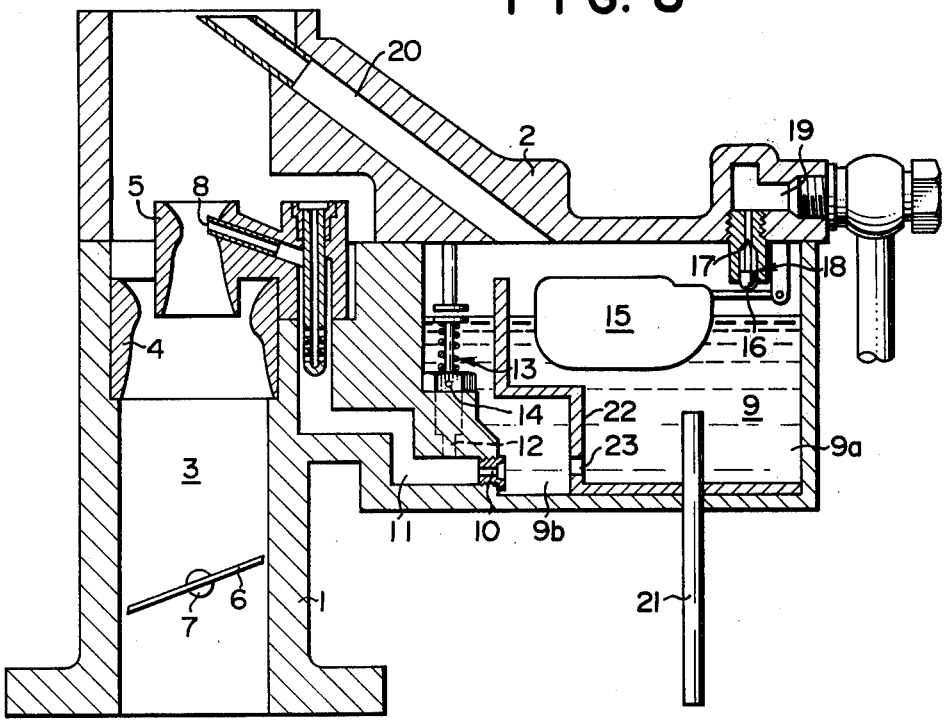
FIG. 8 is a view similar to FIGS. 1, 2, 5 and 6 showing still another embodiment of the present invention.

FIG. 8 shows a further modification of the present invention. Also in FIG. 8, the portions corresponding to those shown in the previous figures are designated by the same reference numerals. In this embodiment the heat pipe 21 is provided in the first region 9*a* of the float chamber so that the heat pipe is isolated from the fuel delivery ports such as the main jet 10 and the power fuel port 14 by the partition 22 having the opening 23. In this case, however, the partition 22 having the opening 23 operates as a screen which prevents bubbles generated by heating of the fuel by the heat pipe from being drawn into the main fuel passage 11 through the main jet 10 or the power fuel port 14. The partition 22 in the structure shown in FIG. 8 may be replaced by a perforated plate having a large number of small openings.

Although the invention has been shown and described with respect to some preferred embodiments thereof, it should be understood by those skilled in the art that various changes and omissions of the form and detail thereof may be made therein without departing from the scope of the invention.

We claim:

1. A fuel supply system comprising a carburetor having:

a body;

a float chamber;

a fuel inlet port opening into the float chamber to supply fuel thereinto;

a fuel outlet port opening from the float chamber at a lower portion thereof to deliver fuel therefrom;

a vent port opening from said float chamber at an upper portion thereof to vent gases therefrom;

a heating element provided in the float chamber so as to be horizontally apart from the fuel outlet port to heat the fuel in the float chamber;

a passage space left in the float chamber which allows gases generated from the fuel heated by said heating element to reach said upper portion of the float chamber due to its own buoyancy; and automatic control means including thermal sensor means connected to energize said heating element when a temperature representative of the temperature of the carburetor body is higher than a reference temperture and in the range of temperatures above moderate normal operating tempertures and to de-energize the heating element when said temperature is lower than said reference temperature.

2. The fuel supply system of claim 1, wherein said heating element is an electric heating element.

3. The fuel supply system of claim 1, wherein said heating element is a pipe adapted to be supplied with a flow of heating medium.

4. A fuel supply system according to claim 1, in which the control means comprising a thermal sensor which detects a temperature representative of the temperature of the carburetor body, and a controller which operates depending upon a signal dispatched from the thermal sensor and controls the supply of energy to the heating element so that the heating element supplies heat to the fuel when the thermal sensor is detecting a temperature above said reference temperature, so that the heating element does not supply heat to the fuel when the thermal sensor is detecting a temperature below said reference temperature.

5. The fuel supply system of claim 1, further comprising a partition having an opening provided in said float chamber so as to divide the internal space of said float chamber into a first region to which said fuel inlet port opens and a second region to which said fuel outlet port opens.

6. The float chamber means of claim 5, wherein said heating element is provided in said first region of said float chamber.

7. The float chamber means of claim 5, wherein said heating element is provided in said second region.

8. The float chamber means of claim 7, further comprising a second vent port which particularly opens to said second region of said float chamber.

* * * * *